United States Patent [19]

Ogawa et al.

[11] Patent Number: 5,013,709

[45] Date of Patent: May 7, 1991

[54] PRESSURE-SENSITIVE RECORDING PAPER AND COLOR DEVELOPER THEREFOR

[75] Inventors: Masahide Ogawa, Shibata; Teiji Sato, Shibata; Kiyoshi Abe, Shibata; Hisashi Tsuchida, Nakajo; Hiroo Inoue, Shiunji; Mitsuo Saito, Nakajo, all of Japan

[73] Assignee: Mizusawa Industrial Chemicals, Ltd., Tokyo, Japan

[21] Appl. No.: 409,416

[22] Filed: Sep. 19, 1989

[30] Foreign Application Priority Data

Feb. 28, 1989 [JP] Japan ..... 1-45331

[51] Int. Cl.[5] ..... B41M 5/16; B41M 5/22

[52] U.S. Cl. ..... 503/225; 106/21; 427/150; 428/342; 502/81; 503/219

[58] Field of Search ..... 106/21; 427/150–152; 503/210–212, 219, 225; 428/342; 502/81

[56] References Cited

U.S. PATENT DOCUMENTS 4,405,371 9/1983 Sugahara et al. ..... 106/21

*Primary Examiner*—Bruce H. Hess

*Attorney, Agent, or Firm*—Sherman and Shalloway

[57] ABSTRACT

Disclosed is a color developer for a pressure-sensitive recording paper, which comprises an acid-treated smectite clay mineral having a specific chemical composition, an X-ray diffraction pattern peculiar to dioctahedral smectite, a specific solid NMR spectrum and a specific cation exchange capacity. This color developer shows a high whiteness, a high initial color density, excellent light resistance and weatherability, and a low viscosity.

8 Claims, 4 Drawing Sheets

PRESSURE-SENSITIVE RECORDING PAPER AND COLOR DEVELOPER THEREFOR

BACKGROUND OF THE INVENTION

1. Field of the Invention

The present invention relates to a color developer for a pressure-sensitive recording paper. More particularly, the present invention relates to a color developer composed of an acid-treated clay mineral, which is capable of forming an image having a high density and a good light resistance by color reaction with a leuco dye or the like.

2. Description of the Related Art

Color reaction of transfer of electrons between a colorless compound of an organic dye having an electron-donating property and a color developer as an electron acceptor is generally utilized for pressure-sensitive recording papers. Known color developers (color formers) are roughly divided into an inorganic acid such as a clay mineral, for example, silica, or an acid-treated product thereof, a phenolic resin formed by reaction between a phenol and formaldehyde, and a zinc salt of an aromatic hydroxycarboxylic acid.

Many proposals have been made on color developers composed of acid-treated clay minerals. For example, Japanese Examined Patent Publication No. 41-7622 proposes a color former for a non-carbon recording paper, which is obtained by treating acid clay or a similar clay with a mineral acid to elute alumina, iron and chlorine components soluble in the acid and which has a specific surface area of at least 200 $m^2/g$. Furthermore, Japanese Examined Patent Publication No. 44-2188 teaches that the secondary coloring performance ($K_2$) of a dioctahedral type montmorillonite clay mineral to Benzoyl Leucomethylene Blue is peculiar to the production place or deposit position, and that if a clay mineral having a secondary coloring performance ($K_2$) exceeding a certain reference value is selected and acid-treated so that the specific surface area is at least 180 $m^2/g$, there can be obtained a color former having an excellent coloring effect to both of a primary color-forming dye and a secondary color-forming dye.

Furthermore, Japanese Examined Patent Publication No. 63-15158 discloses a process for the preparation of a color former for a pressure-sensitive recording paper, which comprises acid-treating a clay mineral having a layer structure consisting of tetrahederons of silica so that the $SiO_2$ content on the dry base is 82 to 96.5% by weight and the diffraction pattern based on the crystal of the layer structure by the X-ray diffractometry and the diffraction pattern based on the crystal of the layer structure by the electron beam diffractometry are not substantially manifested, and introducing a magnesium component and/or an aluminum component in the acid-treated product so that the diffraction pattern based on the crystal of the layer structure by the electron beam diffractometry is manifested again.

SUMMARY OF THE INVENTION

We found that an acid-treated smectite clay mineral having a specific chemical composition, an X-ray diffraction pattern peculiar to dioctahedral smectite, a specific solid NMR spectrum and a specific cation exchange capacity, as described in detail hereinafter, has a high whiteness, a high initial color density (excellent black image density), excellent light resistance and weatherability and a low viscosity in combination as a color developer for a pressure-sensitive recording paper, and if this acid-treated clay mineral is used as a color developer, there can be provided an excellent pressure-sensitive recording paper.

A color developer for a pressure-sensitive recording paper is coated on the surface of a paper to form a front-coated or front- and back-coated paper (CF or CFB paper), and a color image is formed on the coating. Accordingly, from the viewpoint of the sharpness or contrast of the formed image, the color developer is required to have an excellent whiteness. After the appearance of a high-speed printer, it has become important that the color developer should react promptly with a colorless dye applied by printing or the like, and for preservation of printed documents, it is required that the color developer should provide a color image excellent in the light resistance and weatherability. Furthermore, in order to increase the speed of manufacturing a pressure-sensitive recording paper and reduce the cost of heat energy for drying, it is important that a dispersion of the color developer should be an aqueous slurry having a relatively low viscosity even at a high concentration and having an excellent coating property.

When various clay minerals, acid-treated products differing in the degree of the acid treatment and amorphous silica are examined with respect to the above-mentioned characteristics the following can be seen.

Of course, amorphous silica is excellent in the whiteness, but clay minerals are natural products, they are inferior in the whiteness. The whiteness of clay minerals is generally improved by an acid treatment, but the degree of improvement of the whiteness differs according to the crystal structure or the microstructure.

The initial color density tends to increase in clay minerals according to the degree of activation by the acid treatment, but the degree of improvement of the initial color density depends greatly on the crystal structure or microstructure of the clay. In connection with the light resistance and weatherability of a color image, amorphous silica is especially poor, and in general, the light resistance and weatherability are degraded with increase of the degree of the acid treatment in acid-treated clay minerals.

In connection with the viscosity of an aqueous slurry, a clay mineral per se tends to swell and the viscosity is high, and the viscosity tends to decrease with increase of the degree of the acid treatment.

In accordance with the present invention, there is provided a color developer for a pressure-sensitive recording paper consisting of an acid-treated smectite clay mineral, wherein the acid-treated smectite clay mineral has a chemical composition, expressed based on oxides of the product dried at 110° C., comprising 75 to 92% by weight of $SiO_2$, 3.5 to 12.8% by weight of $Al_2O_3$, 0.7 to 3.0% by weight of $Fe_2O_3$ and 0.8 to 5.0% by weight of MgO, the acid-treated smectite clay mineral has an X-ray diffraction pattern peculiar to dioctahedral smectite in spacings of from 1.49 to 1.51 Å, in the $^{27}Al$ solid MAS-NMR measurement the ratio $S_{VI}/S_{IV}$ of the peak area ($S_{VI}$) in the chemical shift range of from 31 ppm to −50 ppm to the peak area ($S_{IV}$) in the chemical shift range of from 31 ppm to 100 ppm is in the range of from 60/40 to 85/15, and the cation exchange capacity is 20 to 60 meq/100 g and the Hunter whiteness is at least 80%.

The color developer for a pressure-sensitive recording paper according to the present invention consists of an acid-treated dioctahedral smectite. The dioctahedral smectite is ideally represented by the following general formula:

$$\frac{x+y}{m} M(R_{2-x}M^{II}_x)[Si_{4-x}M^{III}_y]O_{10}(OH)_2 \cdot nH_2O \quad (1)$$

wherein R represents Al or $Fe^{III}$, $M^{II}$ represents a divalent metal such as Mg or $Fe^{II}$, $M^{III}$ represents a trivalent metal such as Al or $Fe^{III}$, M represents an alkali metal ion, an alkaline earth metal ion or a hydrogen ion, m represents the valency of the ion M, and (x+y) is a number larger than zero.

In the above-mentioned formula (1), the term of $(R_{2-x}M^{II}_x)$ represents a central octahedron layer present in the state bonded to oxygen, and the term of $\{Si_{4-y}M^{III}_y\}$ represents tetrahedron layers present on both the sides of the central octahedron layer in the four-coordinate form bonded to oxygen. When this dioctahedral smectite is acid-treated, parts of metal components M, R and $M^{III}$ contained in the above structure are eluted and removed according to the degree of the acid treatment.

The essential feature of the present invention resides in that a dioctahedral smectite having the following characteristics in the acid-treated state is selected and used.

1 The ratio $S_{VI}/S_{IV}$ ($S_{VI}+S_{IV}=100$) of the peak area ($S_{VI}$) in the magnetic field intensity range of from 31 ppm to −50 ppm to the peak area ($S_{IV}$) in the magnetic field intensity range of from 31 ppm to 120 ppm is from 60/40 to 85/15, especially from 65/35 to 80/20, particularly preferably from 68/32 to 78/22, in the $^{27}Al$ solid MAS-NMR measurement.

2 The chemical composition (% by weight) based on the oxides of the product dried at 110° C. is as follows:

| | Ordinary Range | Preferred Range |
|---|---|---|
| $SiO_2$ | 75 to 92 | 78 to 90 |
| $Al_2O_3$ | 3.5 to 13 | 7.0 to 11.5 |
| $Fe_2O_3$ | 0.7 to 3.0 | 1.0 to 2.5 |
| MgO | 0.8 to 5.0 | 1.0 to 3.5 |

In the accompanying drawings, FIG. 1 shows the NMR (nuclear magnetic resonance) spectrum of an acid-treated product ($S_{VI}/S_{IV}=78/22$) satisfying the conditions of the present invention, FIG. 2 shows the NMR spectrum of an acid-treated product ($S_{VI}/S_{IV}=23/77$) not satisfying the conditions of the present invention, FIG. 3 shows the NMR spectrum of starting smectite giving the acid-treated product shown in FIG. 1, and FIG. 4 shows the NMR spectrum of starting smectite giving the acid-treated product shown in FIG. 2. In these spectra, the peak of $S_{VI}$ corresponds to the number of six-coordinate Al atoms present in the octahedron layer $(R_{2-x}M^{II}_x)$ in the above-mentioned formula, while the peak of $S_{IV}$ corresponds to the number of four-coordinate Al atoms present in the tetrahedron layer $\{Si_{4-y}M^{III}_y\}$ in the above-mentioned formula. From these NMR spectra and $S_{VI}/S_{IV}$ ratios, it is seen that in the dioctahedral smectite, the value of the peak area ratio ($S_{VI}/S_{IV}$) is peculiar to the clay and even though this value is changed to some extent by the acid treatment, the value depends rather on the inherent microstructure determined by the production place, origin and deposit position of the clay.

Table 1 given hereinafter shows aromatic absorption indexes (AAI), initial color densities by a black leuco dye, image densities after the light resistance test using a weather-ometer, whiteness values and viscosities of 25% aqueous slurries, determined with respect to the acid-treated products shown in FIGS. 1 and 2 and the starting clays shown in FIGS. 3 and 4. From Table 1, it is obvious that the acid-treated product having the NMR spectrum shown in FIG. 1 gives best results with respect to all of the foregoing properties.

It is presumed that the reasons why an acid-treated smectite having a peak area ratio ($S_{VI}/S_{IV}$) included in the range specified in the present invention has the above-mentioned excellent characteristics are probably as follows. In the case where smectitie is acid-treated, in general, interlaminar cations M are first eluted according to the degree of the acid treatment, and then, elution of cations of the octahedron layer is caused in order of $M^{II}$, $Fe^{III}$ and Al. Finally, elution of Al in the tetrahedron layer is caused. In the portions where these cations have been eluted, voids are formed in the octahedron layer and further in the tetrahedron layer, and $H^+$ is introduced into these voids to form electron-accepting active sites. Namely, of Al atoms, four-coordinate Al present in the tetrahedron layer has a higher resistance to the acid treatment than six-coordinate Al present in the octahedron layer. Furthermore, in case of smectite of the type shown in FIG. 3, negative charges are produced by isomorphous substitution of $Al \rightarrow M^{II}(Mg)$ in the octahedron layer, but smectite of the type shown in FIG. 4 comes to have negative charges because of isomorphous substitution of $Si \rightarrow Al$. Even if the cation exchange capacity is equal in these smectites, the acid resistance is considerably different between them. In the color developer of the present invention having the above-mentioned peak area ratio, a high activity is obtained in a low degree of the acid treatment. Accordingly, in the color developer of the present invention, a high initial image density can be obtained while retaining excellent light resistance and weatherability, and the viscosity of an aqueous slurry is low and the whiteness is high.

If the value of $S_{VI}/S_{IV}$ is too large and exceeds the range specified in the present invention, formation of active sites is insufficient and the initial image density is low, and the whiteness is below the range specified in the present invention. If the above-mentioned value is too small and below the range specified in the present invention, the initial image density or whiteness is drastically degraded, or the light resistance or weatherability is drastically degraded.

In the present invention, it also is important that the chemical composition should be within the above-mentioned range. If the $SiO_2$ content exceeds the specified range or the $Al_2O_3$ content is below the specified range, the light resistance and weatherability of the formed image are often degraded. If the $SiO_2$ content is below the specified range or the $Al_2O_3$ content exceeds the specified range, reduction of the initial image density or increase of the viscosity of an aqueous slurry is often caused. If the $Fe_2O_3$ content exceeds the specified range, the whiteness tends to decrease, and if the $Fe_2O_3$ content is below the specified range, the light resistance and weatherability of the formed image tend to decrease. Moreover, the MgO content has influences on the image density and the light resistance and weatherability. If the MgO content exceeds the specified range, bad influences are imposed on the image density, and if the MgO content is below the specified range, the light resistance and weatherability are degraded.

In addition to the above-mentioned conditions of 1 and 2, the following conditions should be satisfied in the acid-treated smectite of the present invention. Namely, it is indispensable that 3 the acid-treated smectite should have an X-ray diffraction pattern peculiar to dioctahedral smectite in the spacing range of from 1.49 to 1.51 Å, 4 the acid-treated smectite should have a cation exchange capacity of 20 to 60 meg per 100 g, especially 25 to 55 meq/100 g, and 5 the whiteness should be at least 80%, especially at least 82%.

FIG. 5 of the accompanying drawings shows an X-ray diffraction pattern of the acid-treated product shown in FIG. 1, and FIG. 6 shows an X-ray diffraction pattern of the starting smectite clay shown in FIG. 3. From these X-ray diffraction patterns, it is seen that the color developer of the present invention has an X-ray diffraction pattern peculiar to dioctahedral smectite in the spacing range of from 1.49 to 1.51 Å {060 plane}. Namely, in the color developer of the present invention, although $M^{II}$, $Fe^{III}$ and Al in the octahedron layer have been partially eluted, the basic octahedron layer skeleton is still left. From FIG. 5, it is seen that this color developer also has an X-ray diffraction pattern peculiar to smectite in the spacing range of 4.49 to 4.51 Å {020 plane}. In the color developer of the present invention, this X-ray diffraction pattern is useful for improving the light resistance and weatherability.

The cation exchange capacity depends on the quantity of the interlaminar cation M in the smectite structure. The quantity of this remaining cation M depends on the degree of the acid treatment. In general, the higher is the degree of the acid treatment, the smaller is the quantity of the remaining cation M. If the cation exchange capacity exceeds the above-mentioned range, the initial color density is generally insufficient and the viscosity is high. If the cation exchange capacity is below the above-mentioned range, the light resistance and weatherability of the formed image are readily degraded.

According to the present invention, by virtue of these characteristics combined, there is provided a color developer for a pressure-sensitive recording paper, which has a high whiteness, a high initial color density, excellent light resistance and weatherability, and a low viscosity of a dispersion.

DETAILED DESCRIPTION OF THE PREFERRED EMBODIMENTS

Figure 1:
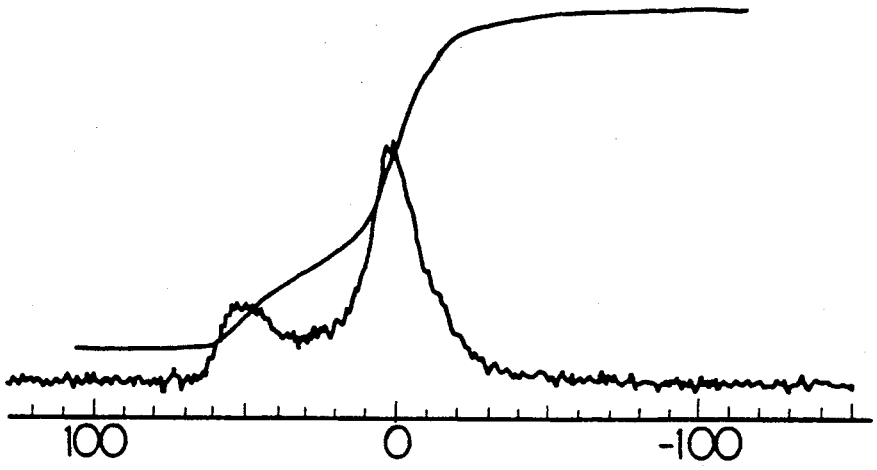
FIGS. 1 through 4 are MAS-NMR spectrum diagrams of sample 1—2, sample H2—2, starting material C—1 and starting material C—5 described hereinafter, respectively.
Figure 2:
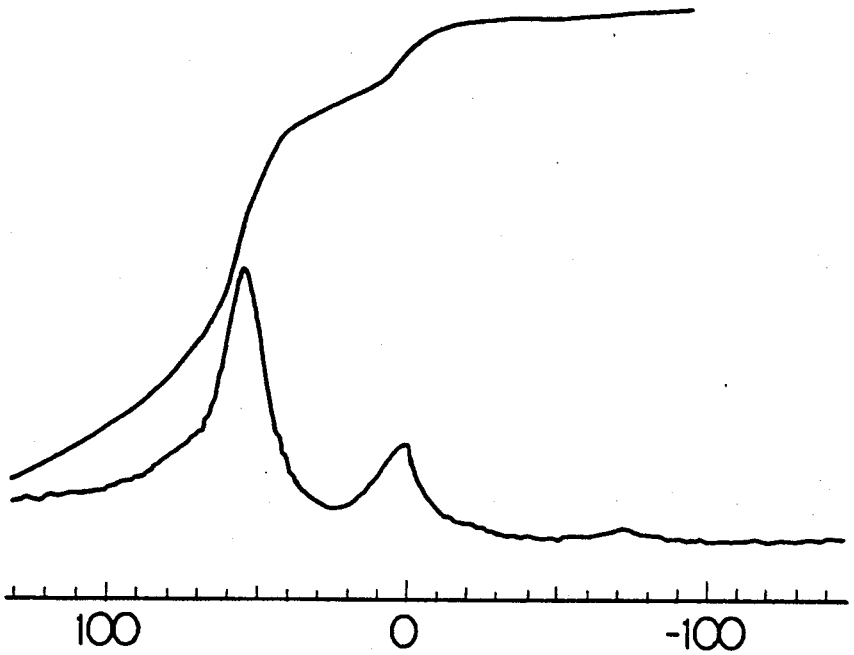
Figure 3:
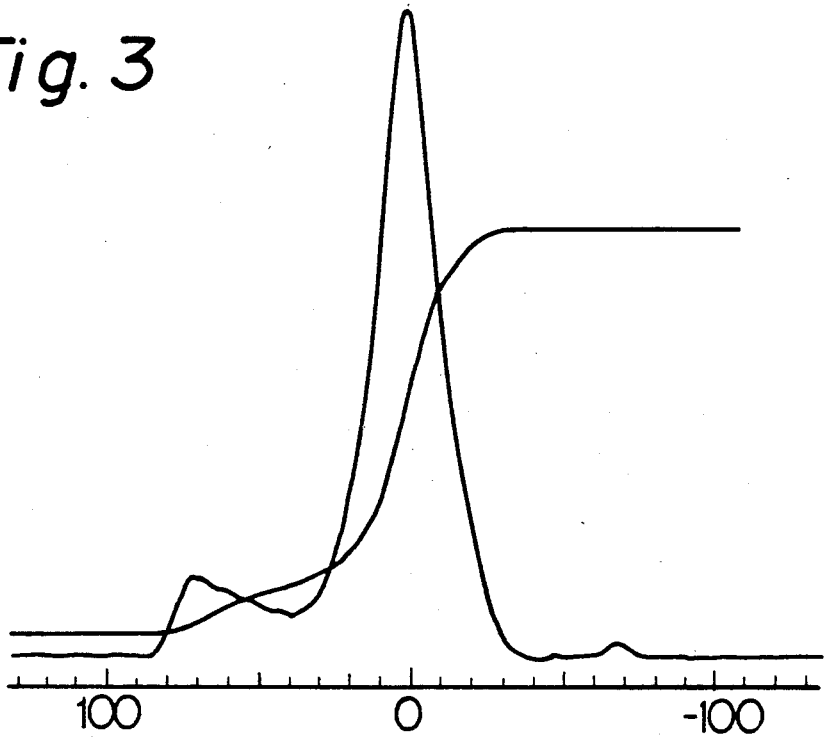
Figure 4:
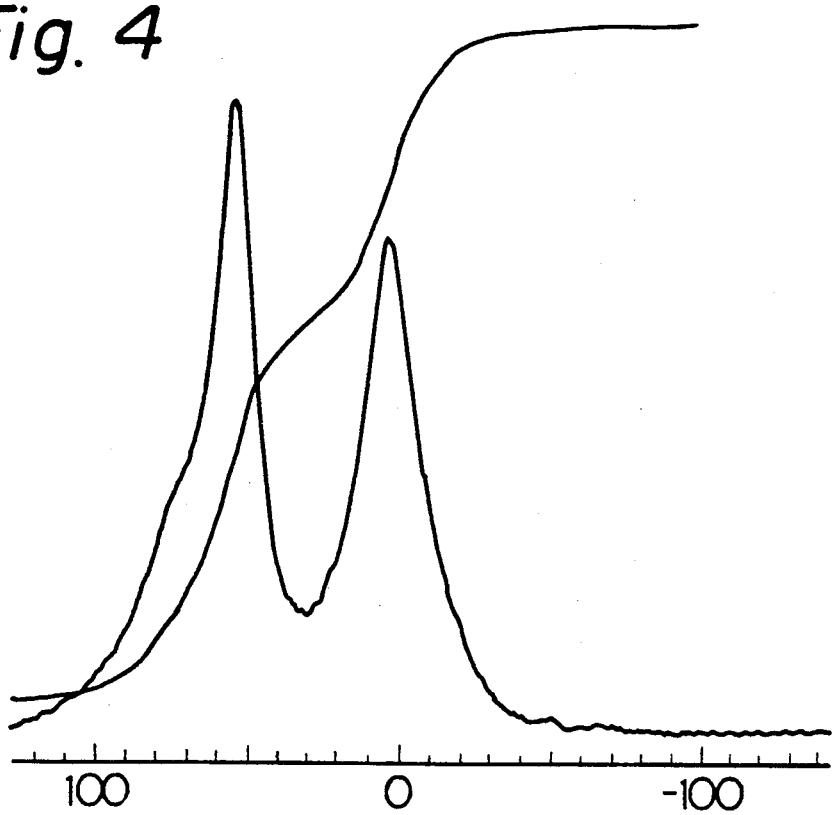
Figure 5:
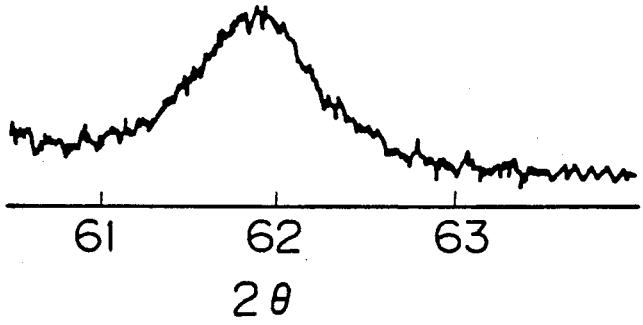
FIGS. 5 and 6 show X-ray diffraction patterns of sample 1—2 and starting material C—1, respectively, which illustrate the diffraction curve peculiar to the plane index {060} of the dioctahedral smectite mineral.
Figure 6:
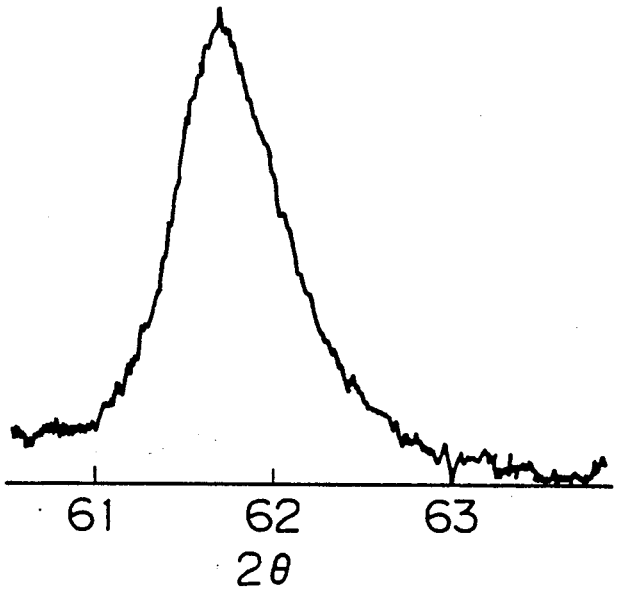

The color developer of the present invention has the above-mentioned characteristic chemical structure, and furthermore, the color developer of the present invention has several characteristic physical properties. In the first place, the color developer has an aromatic adsorption index (AAI) of 20 to 55, especially 20 to 42, as determined by the method described below. The aromatic adsorption index shows the degree of selective adsorption of toluene from an iso-octane/toluene mixed solvent by the color developer. This aromatic adsorption index has a close relation to the capacity of adsorbing a leuco dye solution bleeding from a capsule at the copying operation.

Of course, the color developer used in the present invention has characteristics of the solid acid. Generally, the characteristics of the solid acid are defined by the acid strength (Ho) and acidity. For example, if the solid acid is neutralized with a base such as n-butylamine, neutralization is effected in order according to the degree of the acid strength. If neutralization titration is carried out by using indicators corresponding to respective acid strengths as the indicator indicating the neutralization point, there is obtained a cumulative distribution curve of acidities corresponding to the respective acid strengths. Supposing that the acidity (meq/g) of the solid acid determined by using dicinnamylacetone, which is an indicator having a pka value of $-3.0$, as the indicator is $A_1$ and the acidity (meq/g) of the solid acid determined by using Methyl Red, which is an indicator having a pka value of $+4.8$, as the indicator is $A_2$, the acidity $A_1$ shows the acidity of an acid having a higher acid strength (strong acid), and $A_3$ ($=A_2-A_1$) shows an acidity of an acid having a lower acid strength (weak acid). In the color developer of the present invention, $A_1$ is smaller than 0.5 meq/g, especially smaller than 0.2, and $A_3$ is 0.2 to 1.5 meq/g, especially 0.5 to 1.0 meq/g. It is considered that the above-mentioned acidity distribution of the color developer of the present invention makes a contribution to formation of a sharp, high-density image.

As described in detail hereinafter, the color developer of the present invention has a viscosity of 3 to 50 cp, especially 5 to 20 cp, as measured at a solid concentration of 25% and a pH value of 9.8 to 10.7 by a B-type viscometer. By dint of this characteristic of a relatively low viscosity, the color developer can be coated in the form of a high-concentration dispersion on a paper substrate at a high speed. Moreover, since the amount of water in the dispersion can be reduced as compared with the amount of water in conventional dispersions, the heat energy cost for drying can be reduced.

Moreover, the color developer of the present invention has a median diameter ($D_{50}$) of 2.0 to 10.0 μm, especially 4 to 6 μm, and it is preferred that the content of particles having a particle size larger than 10 μm be lower than 20% by volume, especially lower than 10% by volume.

The starting dioctahedral smectite clay used in the present invention is available in the state where the peak area ratio $S_{VI}/S_{IV}$ in the above-mentioned NMR spectrum is within the range specified in the present invention or exceeds the range specified in the present invention. This microstructure differs according to the origin and production place and also to the deposit position (pit face) even if the production place is the same. Therefore, it is recommended that a clay satisfying the above-mentioned requirements will be selected according to the NMR measurement test and the test of measuring the acid treatment characteristic (Sa) described hereinafter as an expedient means.

It is considered that dioctahedral smectite has been produced by metamorphism of volcanic ash or lava under influences of sea water. During this metamorphism an excessive silicic acid component precipitated in the form of crystallized quartz, cristobalite, opal CT or the like and is often co-present with the smectite clay. In the smectite used in the present invention, it is preferred that the content of this silicic acid component be lower than 92% by weight, especially lower than 88% by weight, in the state of the acid-treated product.

The so-selected dioctahedral smectite clay is subjected to a refining operation such as separation of stone and sand, buoyancy dressing, magnetic dressing, elutriation or air elutriation according to need, and is then subjected to the acid treatment. The acid treatment conditions are determined so that the acid-treated product has the above-mentioned chemical composition, X-ray diffraction pattern, NMR area ratio, cation exchange capacity and Hunter whiteness. The starting smectite clay mineral suitable for the color developer of the present invention comes is converted to an acid-treated clay having the above-mentioned chemical and physical characteristics by the acid treatment under relatively mild conditions. Under severe acid treatment conditions, the smectite structure is destroyed and various characteistics such as color-forming capacity and light resistance are rather degraded. Accordingly, optimum acid treatment conditions should be selected. With respect to certain starting minerals, relations of the acid treatment temperature and time to the above-mentioned characteristics of the acid-treated product are experimentally determined, and the acid treatment can be carried out easily under optimum conditions based on the thus determined relations.

The acid for the acid treatment is selected so that a salt of the metal in the clay mineral and the acid radical of the acid is soluble in water of an aqueous solution of the acid. Mineral acids such as sulfuric acid and hydrochloric acid and organic acids can be used. From the economical viewpoint and in view of the handling easiness, use of a mineral acid is preferred. In view of the acid treatment operation, it is preferred that the concentration of the acid used be 5 to 50% by weight, especially 15 to 35% by weight, and it also is preferred that the acid treatment temperature be 50° to 100° C., especially 60° to 95° C., and the acid treatment time be 1 to 30 hours, especially 5 to 25 hours. The treatment temperature and time are selected within these ranges according to the kind of the starting mineral and the acid concentration so that the above-mentioned conditions are satisfied. The contact of the starting mineral with the acid is conducted according to a method comprising granulating the starting mineral to granules having a certain size, packing the granules in a column and circulating an aqueous solution of an acid in the column, or a method comprising dispersing the starting mineral in an aqueous solution of an acid and effecting the acid treatment in the state of the slurry. By this said treatment interlaminar cations contained in the starting mineral are eluted in the aqueous solution of the acid in the form of salts, and metal components such as $M^{II}$, $Fe^{III}$ and Al in the octahedron layer and Al in the tetrahedron layer are eluted in the aqueous solution of the acid in the form of salts.

At the terminal point of the acid treatment, the aqueous solution of the acid containing these salts is separated from the acid-treated smectite clay and the acid-treated product is washed with water. In the present invention, the salts are preferably removed to such an extent that the amount of water-soluble salts contained in the acid-treated product is smaller than 10% by weight, especially smaller than 5% by weight, as the acid radical of the used acid. Water-soluble salts exert an undesirable function of increasing the viscosity of the aqueous solution of the color developer, even if the amount of the water-soluble salts is considerably small.

The obtained acid-treated product is dried or calcined and then subjected to such a treatment as pulverization or classification according to need, whereby a final product is obtained. It is presumed that by drying or calcination, the concentration of the surface silanol group is reduced and a structure which is hardly swollen in water is given to the color developer. Drying or calcination is preferably carried out at a temperature of 80° to 500° C., especially 100° to 300° C., for 0.5 to 10 hours, especially 0.7 to 5 hours.

The color developer of the present invention is coated on the surface of a paper substrate and is used as a color former layer of a pressure-sensitive recording paper. In the preparation of a pressure-sensitive recording paper, an aqueous slurry containing 20 to 45% by weight, especially 30 to 40% by weight, of the color developer and 4 to 10% by weight, especially 6 to 8% by weight, of a binder is formed, and this aqueous slurry is coated on the surface of a paper substrate and dried. It is preferred that the amount coated of the aqueous slurry be 2 to 15 $g/m^2$, especially 3 to 10 $g/m^2$, as the color developer on the dry base to the surface of the paper substrate. As the binder, there can be mentioned aqueous latex type binders such as a styrene/butadiene copolymer latex and a carboxyl-modified styrene/-butadiene copolymer, self-emulsifiable binders such as a self-emulsifiable acrylic resin, and water-soluble binders such as carboxymethyl cellulose, polyvinyl alcohol, cyanoethylated starch and casein. These binders can be used singly or in the form of mixtures of two or more.

The acid-treated product of the present invention can be used singly as a color developer, or can be used in combination with a known color developer for a leuco dye, such as a phenol, a phenolic resin, zinc salicylate, a derivative thereof or an acid-treated montmorillonite clay as a color developer for a leuco dye. For attaining an extending effect and promoting the color-developing capacity, minerals such as calcium carbonate, zeolites, attapulgite, kaolin and talc can be incorporated into the color developer of the present invention.

All of leuco dyes customarily used for pressure-sensitive recording can be used for reproduction using the pressure-sensitive recording paper of the present invention. For example, triphenylmethane type leuco dyes, fluoran type leuco dyes, spiropyran type leuco dyes, Rhodamine lactam type leuco dyes, Auramine leuco dyes and phenothiazine type leuco dyes can be used singly or in combination. The color developer is used in combination with a fine powder having a layer of microcapsules of a leuco dye as mentioned above for pressure-sensitive recording. The color developer of the present invention exerts especially excellent effects when used in combination with a black leuco dye.

The present invention will now be described in detail with reference to the following examples that by no means limit the scope of the invention.

Referential Example

Figure 7:
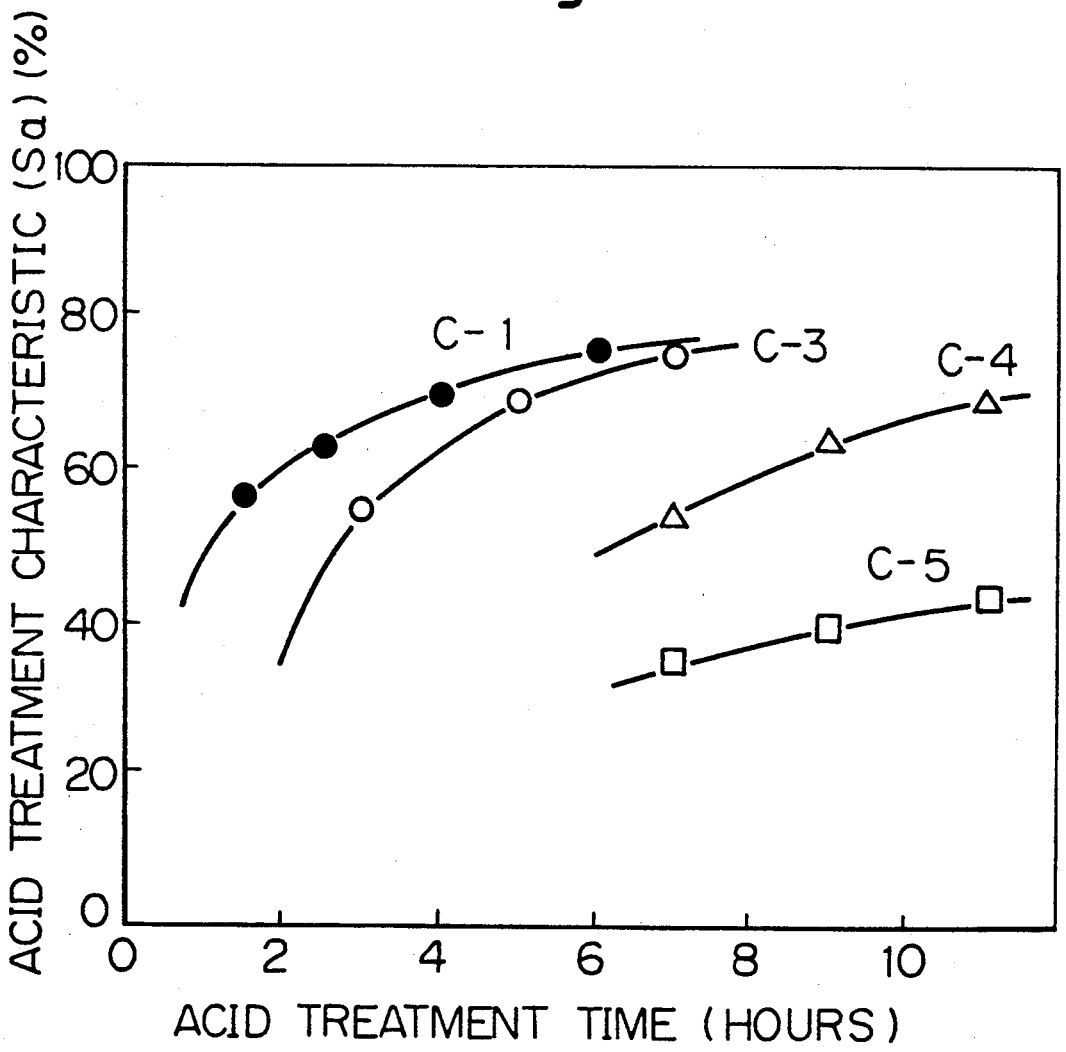
FIG. 7 shows the acid treatment characteristics of starting materials C—1, C—3, C—4 and C—5 relatively to the acid treatment time.

With respect to each of starting clays used in examples and comparative examples, the relation between the treatment time and the reactivity was examined according to the following method, and the obtained result is shown as the acid treatment characteristic (Sa) in FIG. 7.

Acid Treatment Method

An aqueous dispersion having a slurry concentration of 24% was prepared from 300 g of a starting clay (dried at 110° C.) by using a household mixer. The aqueous dispersion was heated at 85° C. and 333 ml of a 74% aqueous solution of sulfuric acid was added to the aqueous slurry with stirring and reaction was carried out over a period of 1 to 11 hours. The amount of the eluted $Al_2O_3$ component was determined by the analysis and the ratio (%) of the eluted $Al_2O_3$ component to the total $Al_2O_3$ component contained in the starting clay was calculated and the result was shown as the reactivity of the starting clay in the acid treatment.

As is apparent from FIG. 7, the starting clays used in examples are different from the starting clays used in comparative examples in the property of eluting the $Al_2O_3$ component, though all of the these starting clays are also dioctahedral smectite clays.

EXAMPLE 1

Acid clay produced at pit face A, Kami-ishikawa, Shibata-shi, Niigata-ken, Japan, which is a dioctahedral smectite clay mineral having the composition shown below, was used as the starting clay (C—1), and a color developer for a pressure-sensitive recording paper was prepared by the following acid treatment. The test results are shown in Table 1.

Acid Treatment Method A

An aqueous dispersion having a slurry concentration of 24% was prepared from 600 kg of the powdery starting material containing 50% of water, and the aqueous dispersion was heated at 85° C. and 333 l of an aqueous solution of sulfuric acid having a concentration of 74% was added to the aqueous dispersion with stirring. Reaction was carried out at the above temperature for 1.5 hours with stirring. Filtration and water washing were conducted until the sulfuric radical was not detected. The recovered solid was dried at 110° C. for 24 hours and was then pulverized by an atomizer to prepare a color developer for a pressure-sensitive recording paper (sample 1—1).

Samples 1-2 and 1-3 were similarly prepared by using starting clay C—1.

| Composition and Characteristics of Starting Clay C-1 | |
|---|---|
| $SiO_2$ | 53.52% |
| $Al_2O_3$ | 27.79% |
| $Fe_2O_3$ | 4.57% |
| MgO | 2.63% |
| ignition loss | 11.50% |
| C.E.C. | 82 meq/100 g |
| AAI | 13 [–] |
| Sa7 | 76% |

Acid Treatment Method B

Columnar granules having a diameter of 6 mm were formed from 3.8 kg of the above-mentioned starting material containing 50% of water, and the granules were packed in a column-type reaction tank having a diameter of 20 cm and a height of 30 cm and were reacted with 26% sulfuric acid at 85° C. for 13 hours. Filtration and water washing were conducted in the same manner as described above. The recovered solid was dried at 110° C. and pulverized by an atomizer to obtain a color developer for a pressure-sensitive recording paper (sample 1-4).

Test Methods

The following test methods were adopted in the present invention.

1. X-Ray Diffractometry

In examples, an X-ray diffraction apparatus supplied by Rigaku Denki (X-ray generator 4036A1, goniometer 2125D1, counter 5071) was used.

The diffraction conditions adopted were as follows.

| | |
|---|---|
| Target: | Cu |
| Filter: | Ni |
| Detector: | SC |
| Voltage: | 35 KVP |
| Current: | 15 mA |
| Counting Full scale: | 8000 c/s |
| Time Constant: | 1 second |
| Scanning Speed: | 2°/min |
| Chart Speed: | 2 cm/min |
| Radiation Angle: | 1° |
| Slit Width: | 0.3 mm |
| Glancing Angle: | 6° |

2. Hunter Whiteness

An automatic reflectometer, Model TR-600 supplied by Tokyo Denshoku, was used for the measurement.

3. Measurement of Solid NMR and Calculation of $S_{VI}/S_{IV}$ Ratio

The measurement of $^{27}Al$ solid MAS-NMR was carried out by using an NMR apparatus, Model JEOL FX 200 supplied by Nippon Denshi.

$^{27}Al$ Measurement Conditions

| | |
|---|---|
| Apparatus: | Model JEOL FX 200 (magnetic field intensity = 4.7T) |
| Temperature: | room temperature |
| Reference substance: | saturated $Al_2(SO_4)_3$ |
| Resonance Frequency: | 52.003 MHz |
| Pulse Width: | 5.0 μsec (90°) |
| Acquisition Time: | 25.6 msec |
| Pulse Delay Time: | 5.00 sec |
| Data Point: | 8K |
| Sampling Point: | 2K |
| Spectrum Width: | 40000 Hz |
| Integration Frequency: | 6000 |

Calculation of $S_{VI}/S_{IV}$ Ratio

The peak area ($S_{VI}$) of the chemical shift range of from 31 ppm to −50 ppm and the peak area ($S_{IV}$) of the chemical shift range of from 31 ppm to 100 ppm were determined from the integration curve of the MAS-NMR spectrography by the above-mentioned method, and the $S_{VI}/S_{IV}$ ratio was calculated from these peak areas.

4. Acid Treatment Characteristic Value (Sa7) of Starting Clay (Starting Material)

A starting clay dried at 110° C. was formed into an aqueous slurry having a concentration of 14% by weight, and an aqueous solution of sulfuric acid ($H_2SO_4$) having a concentration of 75% was added to the aqueous slurry so that the concentration of sulfuric acid ($H_2SO_4$) was 20% by weight. Reaction was carried out at 85° C. for 7 hours. The amount of the eluted alumina component was determined by the analysis and the elution ratio was calculated by the following formula as the acid treatment characteristic value (Sa7) of the starting material:

$$Sa7 = A_1/A_0 \times 100\ (\%)$$

wherein $A_0$ represents the weight of the total $Al_2O_3$ component contained in the starting material, $A_1$ represents the weight of the $Al_2O_3$ component eluted by the above-mentioned acid treatment.

5. Measurement of Color-Developing Capacity

An image-forming paper was placed in a desiccator charged with a saturated aqueous solution of sodium chloride (relative humidity=75%) and stored at room temperature (25° C.) in the dark place. After the lapse of 24 hours from the coating operation, the image-receiving paper was taken out from the desiccator and placed in a room maintained at a constant temperature of about 25° C. and a constant relative humidity of 60% for 16 hours. The image-forming paper was superposed on a commercially available transfer paper coated with microcapsules comprising CVL (Crystal Violet Lactone), which is an instant color-forming leuco dye, as the main dye and PLMB (Benzoyl Leuco Methylene Blue) and a fluoran type leuco dye (red coloring) as auxiliary dyes, so that the coated surfaces of both of the papers confronted each other. The papers were compressed and turned between two steel rolls to crush the microcapsules substantially completely and effect color development. The color-developing capacity of each image-receiving paper was evaluated based on the value of the color (developed color) density (hereinafter referred to as "density") measured by a densitometer (Fuji Densitometer Model FSD-103 supplied by Fuji Shashin Film) after the lapse of 1 hour from the color development. A higher density indicates a higher color-developing capacity.

6. Light Resistance

The color-developed image forming paper used for measurement (5) was exposed to a weather-ometer for 3 hours. The density of the faded color-developed surface of the image-forming surface was measured as the residual density by the densitometer. Furthermore, the color fading or discoloration of the color-developed surface of the image-forming paper and the yellowing of the background were examined with the naked eye.

7. Cation Exchange Capacity (C.E.C.)

The cation exchange capacity was determined by the test method TIKS-413 published by Inorganic Sand Mold Research Section, Tokai Branch of Japanese Casting Association.

8. Measurement of AAI

The aromatic adsorption index (AAI) was measured according to the method of Pratt {T. W. Pratt. Proc., 27th Annual Meeting, Am. Petr. Inst. (1947) by using the recipe of Mizutani et al. Yoshiyuki Mizutani and Kazuo Sakaguchi, "KOKA", 59, 1399 (1958)} described below.

To 2 ml of a mixed solution comprising 70% by volume of iso-octane and 30% by volume of toluene was added 1 g of a sample dried at 150° C. for 3 hours in advance, and the mixture was sufficiently shaken at room temperature. The refractive index was measured and AAI was calculated according to the following formula:

$$AAI = (n_{20}^{D} - n'_{20}^{D}) \times 10^4$$

wherein $n_{20}^{D}$ represents the refractive index of the starting liquid and $n'_{20}^{D}$ represents the refractive index of the sample dispersion.

Incidentally, AAI values of typical adsorbants are as follows.

| | |
|---|---|
| silica gel: | 75 to 85 |
| alumina gel: | 34 to 40 |
| active carbon: | 80 to 120 |
| molecular sieve: | 0 |

9. Measurement of Viscosity

A glass vessel was charged with 100 g of pulverizing alumina balls and 24 g of a sample (dried at 110° C.), and water and an aqueous solution of caustic soda having a concentration of 30% were added to form a slurry having a solid concentration of 25% and a pH value of 9.8 to 10.7. Wet pulverizing was carried out for 15 minutes by a paint conditioner and the viscosity was measured by a B type viscometer 1 minute after the pulverization.

TABLE 1

| Sample No. | 1-1 | 1-2 | 1-3 | 1-4 |
|---|---|---|---|---|
| Acid Treatment Conditions | | | | |
| sulfuric acid concentration (%) | 24 | 24 | 24 | 26 |
| reaction temperature (°C.) | 85 | 85 | 85 | 85 |
| reaction time (hours) | 1.5 | 2.5 | 3.0 | 13 |
| Composition (% by weight) | | | | |
| $SiO_2$ | 75.52 | 79.13 | 81.08 | 83.8 |
| $Al_2O_3$ | 12.13 | 10.33 | 8.53 | 8.10 |
| $Fe_2O_3$ | 2.09 | 1.76 | 1.45 | 1.21 |
| MgO | 1.55 | 1.31 | 1.07 | 0.95 |
| ignition loss | 7.98 | 7.72 | 7.28 | 5.94 |
| $S_I\gamma/S_{II}$ Ratio | 81/19 | 78/22 | 75/25 | 71/29 |
| C.E.C (meq/100 g) | 58 | 50 | 43 | 41.5 |
| AAI | 38 | 40 | 36 | 32 |
| Hunter Whiteness (%) | 86.2 | 86.4 | 86.0 | 86.2 |
| Viscosity (cps) | 12.1 | 9.0 | 9.3 | 9.6 |
| Color-Developing Capacity and Light Resistance | | | | |
| CVL | 86(58)*1 | 84(58) | 86(54) | 86(56) |
| Blue | 100(70) | 97(72) | 99(70) | 100(71) |
| Black | 97(66) | 96(66) | 97(66) | 98(68) |

Note
*1each parenthesized value indicates light resistance

EXAMPLE 2

A color developer was prepared by the acid treatment method A from acid clay produced at pit face B, Kami-ishikawa, Shibata-shi, Niigata-ken, Japan as the starting clay (C—2). The test results are shown in Table 2.

| Composition and Characteristics of Starting Clay C-2 | |
|---|---|
| $SiO_2$ | 57.47% |
| $Al_2O_3$ | 24.39% |
| $Fe_2O_3$ | 4.32% |
| MgO | 3.50% |
| ignition loss | 9.53% |
| C.E.C. | 80 meq/100 g |
| AAI | 12 [–] |
| Sa7 | 68% |

TABLE 2

| Sample No. | 2-1 | 2-2 |
|---|---|---|
| Acid Treatment | | |

TABLE 2-continued

| Sample No. | 2-1 | 2-2 |
|---|---|---|
| Conditions | | |
| sulfuric acid concentration (%) | 23 | 23 |
| reaction temperature (°C.) | 85 | 85 |
| reaction time (hours) | 2.5 | 3.5 |
| Composition (% by weight) | | |
| $SiO_2$ | 77.66 | 80.78 |
| $Al_2O_3$ | 11.70 | 10.02 |
| $Fe_2O_3$ | 1.59 | 1.30 |
| MgO | 1.79 | 1.54 |
| ignition loss | 7.12 | 6.57 |
| $S_{VI}/S_{IV}$ Ratio | 79/21 | 70/30 |
| C.E.C (meq/100 g) | 48 | 42 |
| AAI | 36 | 29 |
| Hunter Whiteness (%) | 85.9 | 86.0 |
| Viscosity (cps) | 13.5 | 11.0 |
| Color-Developing Capacity and Light Resistance | | |
| CVL | 81(57)*1 | 81(57) |
| Blue | 95(76) | 98(75) |
| Black | 95(71) | 94(68) |

Note
*1each parenthesized value indicates light resistance

EXAMPLE 3

Acid clay produced at pit face C, Kami-ishikawa, Shibata-shi, Niigata-ken, Japan, which is a dioctahedral smectite clay mineral (hereinafter referred to as "smectite clay mineral") having the following composition, was acid-treated as the starting clay (C—3) according to the method A described in Example 1. The test results of obtained color developers (samples 3—1, 3—2, 3—3 and 3—4) are shown in Table 3.

| Composition and Characteristics of Starting Clay C-3 | |
|---|---|
| $SiO_2$ | 69.55% |
| $Al_2O_3$ | 14.19% |
| $Fe_2O_3$ | 3.08% |
| MgO | 5.21% |
| ignition loss | 5.07% |
| C.E.C. | 87 meq/100 g |
| AAI | 19 [–] |
| Sa7 | 75% |

TABLE 3

| Sample No. | 3-1 | 3-2 | 3-3 | 3-4 |
|---|---|---|---|---|
| Acid Treatment Conditions | | | | |
| sulfuric acid concentration (%) | 24 | 22.4 | 24 | 23.8 |
| reaction temperature (°C.) | 85 | 85 | 85 | 85 |
| reaction time (hours) | 2 | 3 | 5 | 7 |
| Composition (% by weight) | | | | |
| $SiO_2$ | 79.46 | 85.80 | 89.40 | 91.55 |
| $Al_2O_3$ | 10.75 | 6.54 | 4.34 | 3.57 |
| $Fe_2O_3$ | 2.20 | 1.40 | 0.98 | 0.77 |
| MgO | 3.09 | 1.76 | 1.18 | 0.87 |
| ignition loss | 5.48 | 4.59 | 3.89 | 3.42 |
| $S_{VI}/S_{IV}$ Ratio | 84:16 | 82:18 | 78:21 | 78:22 |
| C.E.C (meq/100 g) | 63 | 42 | 27 | 23 |
| AAI | 28 | 38 | 34 | 28 |
| Hunter Whiteness (%) | 82.5 | 84.5 | 84.8 | 88.4 |
| Viscosity (cps) | 11.5 | 9.5 | 9.1 | 9.0 |
| Color-Developing Capacity and Light Resistance | | | | |
| CVL | 86(68)*1 | 86(61) | 89(56) | 89(46) |
| Blue | 90(73) | 99(77) | 101(71) | 98(64) |
| Black | 86(70) | 98(68) | 98(61) | 98(57) |

Note
*1each parenthesized value indicates light resistance

Then, color developers (samples 3—5, 3—6 and 3—7) were acid-treated according to the method B described in Example 1. The test results are shown in Table 4.

TABLE 4

| Sample No. | 3-5 | 3-6 | 3-7 |
|---|---|---|---|
| Acid Treatment Conditions | | | |
| sulfuric acid concentration (%) | 26 | 26 | 26 |
| reaction temperature (°C.) | 90 | 90 | 85 |
| reaction time (hours) | 9 | 13 | 18 |
| Composition (% by weight) | | | |
| $SiO_2$ | 79.6 | 81.76 | 82.5 |
| $Al_2O_3$ | 8.82 | 8.71 | 7.91 |
| $Fe_2O_3$ | 1.73 | 1.66 | 1.24 |
| MgO | 1.95 | 1.80 | 1.54 |
| ignition loss | 7.9 | 5.17 | 6.81 |
| $S_{VI}/S_{IV}$ Ratio | 68:32 | 65:35 | 62:38 |
| C.E.C (meq/100 g) | 54 | 49 | 41 |
| AAI | 32 | 29 | 33 |
| Hunter Whiteness (%) | 81 | 82 | 83 |
| Viscosity (cps) | 9.5 | 9.2 | 9.0 |
| Color-Developing Capacity and Light Resistance | | | |
| CVL | 83(60)*1 | 84(60) | 89(54) |
| Blue | 93(80) | 99(81) | 94(79) |
| Black | 96(76) | 100(74) | 98(70) |

Note
*1each parenthesized value indicates light resistance

COMPARATIVE EXAMPLE 1

Acid clay (starting clay C—4) produced at Kodo, Shibata-shi, Niigata-ken, Japan and acid clay (starting clay 5) produced at Kushibiki-cho, Yamagata-ken, Japan, which are smectite clay minerals having compositions described below, were acid-treated according to the method A described in Example 1. The test results of obtained comparative samples H1 and H2 are shown in Tables 5 and 6.

| Compositions and Characteristics of Starting Clays | Starting Clay C-4 | Starting Clay 5 |
|---|---|---|
| $SiO_2$ (%) | 72.74 | 75.08 |
| $Al_2O_3$ (%) | 13.30 | 12.55 |
| $Fe_2O_3$ (%) | 3.26 | 2.36 |
| MgO (%) | 2.62 | 2.81 |
| ignition loss | 5.61 | 4.97 |
| C.E.C. (meg/100 g) | 58 | 52 |
| AAI | 12 | 11 |
| Sa7 (%) | 54 | 35 |

TABLE 5

| Sample No. | H1-1 | H1-2 | H1-3 |
|---|---|---|---|
| Acid Treatment Conditions | | | |
| sulfuric acid concentration (%) | 24 | 24 | 24 |
| reaction temperature (°C.) | 85 | 85 | 85 |
| reaction time (hours) | 3 | 7 | 11 |
| Composition (% by weight) | | | |
| $SiO_2$ | 80.15 | 84.67 | 86.08 |
| $Al_2O_3$ | 10.98 | 8.61 | 7.53 |

TABLE 5-continued

| Sample No. | H1-1 | H1-2 | H1-3 |
|---|---|---|---|
| $Fe_2O_3$ | 2.89 | 1.37 | 1.19 |
| MgO | 1.55 | 0.99 | 0.81 |
| ignition loss | 3.85 | 3.47 | 3.12 |
| $S_{VI}/S_{IV}$ Ratio | 50/50 | 60/40 | 64/36 |
| C.E.C (meq/100 g) | 46 | 37 | 31.4 |
| AAI | 14 | 15 | 16 |
| Hunter Whiteness (%) | 88.6 | 89.0 | 90.8 |
| Viscosity (cps) | measurement impossible | measurement impossible | 66.10 |
| Color-Developing Capacity and Light Resistance | | | |
| CVL | 58(35)*1 | 66(41) | 72(41) |
| Blue | 74(64) | 83(62) | 91(65) |
| Black | 68(60) | 81(61) | 90(63) |

Note
*1each parenthesized value indicates light resistance

TABLE 6

| Sample No. | H2-1 | H2-2 | H2-3 |
|---|---|---|---|
| Acid Treatment Conditions | | | |
| sulfuric acid concentration (%) | 23.0 | 22.7 | 23.0 |
| reaction temperature (°C.) | 85 | 85 | 85 |
| reaction time (hours) | 3 | 7 | 11 |
| Composition (% by weight) | | | |
| $SiO_2$ | 80.50 | 88.99 | 90.15 |
| $Al_2O_3$ | 10.35 | 5.72 | 3.85 |
| $Fe_2O_3$ | 1.89 | 1.09 | 0.73 |
| MgO | 2.05 | 1.07 | 0.71 |
| ignition loss | 4.02 | 3.50 | 3.00 |
| $S_{VI}/S_{IV}$ Ratio | 40:60 | 23:77 | 18:82 |
| C.E.C (meq/100 g) | 42 | 29.8 | 23 |
| AAI | 18 | 17.0 | 16 |
| Hunter Whiteness (%) | 82.5 | 84.3 | 86.3 |
| Viscosity (cps) | 11 | 9 | 8 |
| Color-Developing Capacity and Light Resistance | | | |
| CVL | 68(55)*1 | 74(46) | 77(41) |
| Blue | 84(65) | 89(69) | 88(62) |
| Black | 90(70) | 90(68) | 87(61) |

Note
*1each parenthesized value indicates light resistance

We claim:

1. A color developer for a pressure-sensitive recording paper comprising an acid-treated smectite clay mineral, wherein the acid-treated smectite clay mineral has a chemical composition, expressed based on oxides of the product dried at 110° C., comprising 75 to 92% by weight of $SiO_2$, 3.5 to 12.8% by weight of $Al_2O_3$, 0.7 to 3.0% by weight of $Fe_2O_3$ and 0.8 to 5.0% by weight of MgO, the acid-treated smectite clay mineral has an X-ray diffraction pattern peculiar to dioctahedral smectite in spacings of from 1.49 to 1.51 Å, in the $^{27}A$ solid MAS-NMR measurement the ratio $S_{VI}/S_{IV}$ of the peak area ($S_{VI}$) in the chemical shift range of from 31 ppm to −50 ppm to the peak area ($S_{IV}$) in the chemical shift range of from 31 ppm to 100 ppm is in the range of from 60/40 to 85/15, and the cation exchange capacity is 20 to 60 meg/100 g and the Hunter whiteness is at least 80%.

2. A color developer as set forth in claim 1, wherein the peak area ratio $S_{VI}/S_{IV}$ is in the range of from 68/32 to 78/22.

3. A color developer as set forth in claim 1, wherein the chemical composition comprises 78 to 90% by weight of $SiO_2$, 7.0 to 11.5% by weight of $Al_2O_3$, 1.0 to 2.5% by weight of $Fe_2O_3$ and 1.0 to 3.5% by weight of MgO.

4. A color developer as set forth in claim 1, wherein the viscosity is 3 to 50 cp as measured at a solid concentration of 25% and a pH value of 9.8 to 10.7 by a B-type viscometer.

5. A color developer as set forth in claim 1, wherein the median diameter ($D_{50}$) is 2.0 to 10 μm as measured by a Coulter Counter.

6. A pressure-sensitive recording paper comprising a paper substrate and a layer of a color developer comprising a color developer composed of an acid-treated smectite clay mineral and a binder, which is formed on the surface of the paper substrate, wherein the acid-treated smectite clay mineral has a chemical composition, expressed based on oxides of the product dried at 110° C., comprising 75 to 92% by weight of $SiO_2$, 3.5 to 12.8% by weight of $Al_2O_3$, 0.7 to 3.0% by weight of $Fe_2O_3$ and 0.8 to 5.0% by weight of MgO, the acid-treated smectite clay mineral has an X-ray diffraction pattern peculiar to dioctahedral smecite in spacings of from 1.49 to 1.51 Å, in the $^{27}Al$ solid MAS-NMR measurement of the acid-treated smectite clay mineral, the ratio $S_{VI}/S_{IV}$ of the peak area ($S_{VI}$) in the chemical shift range of from 31 ppm to −50 ppm to the peak area ($S_{IV}$) in the chemical shift range of from 31 ppm to 100 ppm is in the range of from 60/40 to 85/15, and the acid-treated smectite clay mineral has a cation exchange capacity of 20 to 60 meg/100 g and a Hunter whiteness of at least 80%.

7. The pressure-sensitive recording paper of claim 6 wherein the layer of the color developer weighs from 2 to 15 grams per square meter.

8. The pressure-sensitive recording paper of claim 6 wherein the layer of the color developer comprises from 20 to 45 parts by weight of the color developer composed of the acid-treated smectite clay mineral and from 4 to 10 parts by weight of the binder.

* * * * *